United States Patent [19]

Okuda et al.

[11] Patent Number: 4,627,455

[45] Date of Patent: Dec. 9, 1986

[54] UMBRELLA RIB LINKAGE SYSTEM

[75] Inventors: Toshio Okuda, Hirakata, Japan; Tsun-Zong Wu, Taipei, Taiwan

[73] Assignees: 'totes', incorporated; Fu Tai Umbrella Works Ltd.

[21] Appl. No.: 675,209

[22] Filed: Nov. 27, 1984

[30] Foreign Application Priority Data

Nov. 30, 1983 [TW] Taiwan ..... 7228218
Dec. 12, 1983 [JP] Japan ..... 58-191922[U]

[51] Int. Cl.[4] ..... A45B 19/00; A45B 25/00
[52] U.S. Cl. ..... 135/25 A; 135/31
[58] Field of Search ..... 135/25 R, 25 A, 29, 135/31

[56] References Cited

U.S. PATENT DOCUMENTS

| | | | |
|---|---|---|---|
| 177,339 | 5/1876 | Kirkham | 135/25 R |
| 180,719 | 8/1876 | Kirkham | 135/25 R |
| 570,857 | 11/1896 | Plack, Jr. et al. | 135/31 |
| 1,223,138 | 4/1917 | Blythe | 135/25 R |
| 1,728,489 | 9/1929 | Hanson | 135/29 |
| 2,076,525 | 4/1937 | Bouma | 135/25 R |
| 2,215,738 | 9/1940 | Kohler | 135/25 R |
| 3,467,115 | 9/1969 | Brooks et al. | 135/25 R |
| 3,746,024 | 7/1973 | Kida | 135/20 R |
| 3,850,188 | 11/1974 | Saito | 135/22 |
| 3,853,136 | 12/1974 | Schwartzenberg | 135/25 R |
| 3,893,467 | 7/1975 | Wingen | 135/25 R |
| 3,901,257 | 8/1975 | Schafer . | |
| 4,105,039 | 8/1978 | Schultes et al. | 135/25 A |
| 4,420,007 | 12/1983 | Wu | 135/25 R |

FOREIGN PATENT DOCUMENTS

| | | | |
|---|---|---|---|
| 812693 | 7/1951 | Fed. Rep. of Germany | 135/25 R |
| 2244956 | 1/1974 | Fed. Rep. of Germany | 135/25 R |
| 4895853 | 2/1972 | Japan | 135/25 R |
| 1328694 | 1/1973 | United Kingdom | 135/25 R |

*Primary Examiner*—Robert A. Hafer
*Assistant Examiner*—D. Neal Muir
*Attorney, Agent, or Firm*—Wood, Herron & Evans

[57] ABSTRACT

A rib linkage system of the topless type. A stretcher rib connects the umbrella's runner with each cover rib, a support rib connects the umbrella's ferrule with each stretcher rib, and a control link connects each support rib with its associated cover rib. The connection of the support rib with the stretcher rib is by means of a split or bifurcated brace structure that enhances the stability of the linkage system when the umbrella is full opened. The control link, support rib, stretcher rib, and cover rib all cooperate to define a generally parallelogram configuration beneath the stretcher rib when the umbrella is in between its full opened and full closed positions, and to define a generally triangular configuration when the umbrella is full opened, again to enhance the stability of the linkage system when the umbrella is opened and also to permit the umbrella to collapse into a short and compact storage or full closed position.

28 Claims, 5 Drawing Figures

UMBRELLA RIB LINKAGE SYSTEM

This invention relates to umbrellas. More particularly, this invention relates to an improved umbrella rib linkage system, and to an umbrella that incorporates that improved rib linkage system.

There are two basic types of umbrellas, namely, stick umbrellas and collapsible umbrellas. In a stick umbrella, the umbrella centerpost is of a single fixed length. In a collapsible umbrella, on the other hand, the umbrella centerpost is composed of two or more sections that can telescope one within the other in order to shorten the centerpost length and, thereby, shorten the umbrella itself, when it is in the collapsed or storage position. Collapsible umbrellas, have been well received in the market place in recent years, because they are so easy to store and to carry by their owners. A collapsible umbrella can be carried in a briefcase or handbag or the like so it is always available for use if the need arises, whereas a stick umbrella is normally only carried when it appears that its use will be necessary.

A rib linkage system for a collapsible umbrella must permit an overall umbrella length that is reasonably short in the storage or full closed position, relative to the full opened or use position, so the umbrella can be easily stored or carried wherever desired by the user. There are a couple of different basic types of rib linkage systems by which a collapsible umbrella's cover can be erected and collapsed that meet this short length objective, one being of a simpler structure and easier to operate, than the others. This one type of collapsible umbrella rib linkage system has seen significant success in the market place, and is known as a topless umbrella rib linkage system. The topless rib linkage system is particularly useful and practical in connection with collapsible umbrellas. The topless umbrella rib linkage system incorporates a series of cover ribs that only partially support the umbrella's cover when it is open. The cover ribs extend radially inward from the outer periphery of the cover toward the centerpost, but they stop significantly short of the centerpost, e.g., they may only extend half the radial distance from the cover's outer periphery to the centerpost. Thus, the cover ribs are not directly connected to the umbrella's ferrule. This is contrary to other rib linkage systems in which the umbrella's cover ribs are directly connected to the umbrella's centerpost and do extend radially outward from the centerpost to the cover's periphery. One such topless rib linkage system that has been well received in the collapsible umbrella market place is that illustrated in Brooks et al. U.S. Pat. No. 3,467,115.

A collapsible umbrella must be relatively short when it is collapsed for storage, but it also must be of regular or usable size when it is open. In other words, it is desirable to maintain as large a radius a possible for the umbrella's cover when the umbrella is full opened, while providing a rib linkage system that permits the centerpost and rib linkages, as well as the cover, to be retracted to a desirably short overall length when it is in a storage or full collapsed position. But in meeting this overall objective, it also is necessary that the umbrella's rib linkage system be relatively strong so as to withstand wind forces to which the umbrella my be subjected during use. In this regard, it is necessary that the umbrella's rib linkage system be strong against wind induced forces generally parallel to the centerpost that might tend to collapse the rib linkages, as well as wind induced forces generally perpendicular to the centerpost that might tend to sway or bend the rib linkages.

Accordingly, it has been the objective of this invention to provide an umbrella with a novel rib linkage system of the topless type, that rib linkage system being of suitable stability and strength so as to permit practical use of the umbrella by the umbrella's owner, and that rib linkage system being structured to permit use of it in a collapsible umbrella that is of a relatively short length.

In accord with this objective, the improved umbrella rib linkage system of this invention includes a stretcher rib that connects the umbrella's runner with each cover rib, and a support rib that connects the umbrella's ferrule with each stretcher rib, and a control link that connects each support rib with its associated cover rib. The connection of the support rib with the stretcher rib is by means of a split or bifurcated brace structure that enhances the stability of the linkage system when the umbrella is full opened. The control link, support rib, stretcher rib, and cover rib all cooperate to define a generally parallelogram configuration beneath the stretcher rib when the umbrella is in between its full opened and full closed positions, and to define a generally triangular configuration when the umbrella is full opened, again to enhance the stability of the linkage system when the umbrella is opened and also to permit the umbrella to collapse into a short and compact storage or full closed position.

Other objectives and advantages of the invention will be more apparent from the following detailed description of the invention taken in conjunction with the drawings in which.

Figure 1:
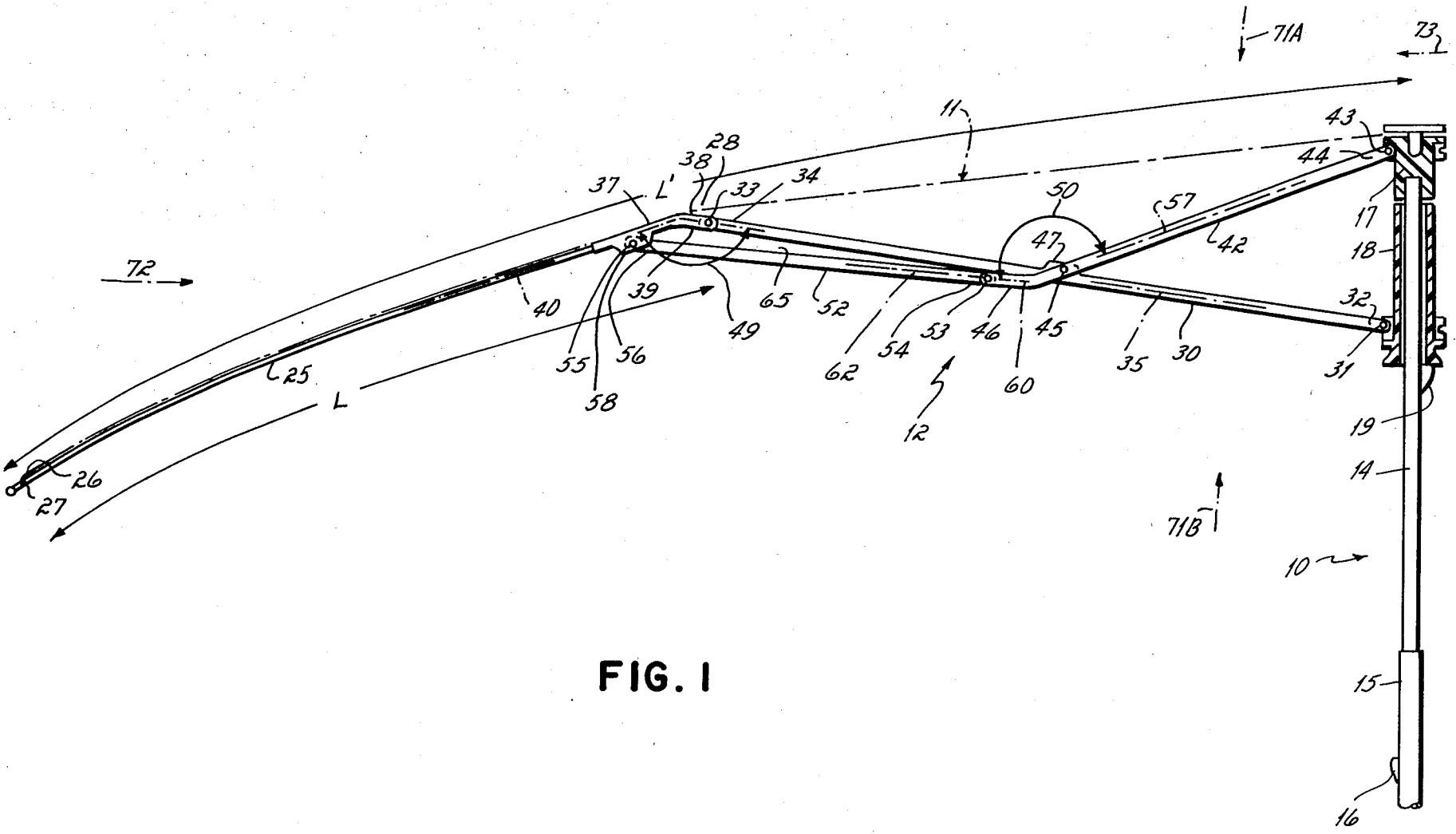
FIG. 1 is a side view of an umbrella in accord with the principles of this invention, the umbrella being shown in the full opened position.
Figure 3:
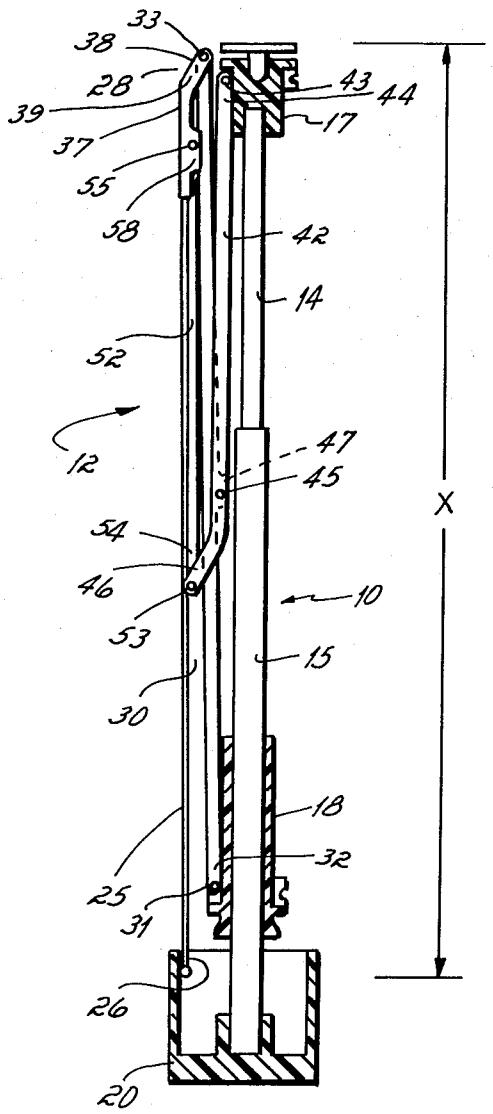
FIG. 3 is a side view similar to FIGS. 1 and 2 but showing the umbrella in the full closed position.

An umbrella in accord with the principles of this invention is illustrated in FIGS. 1 and 3. The umbrella, which is collapsible into a storage position shown in FIG. 3 and erectable into a use position shown in FIG. 1, basically includes a centerpost 10, a cover 11, and a series of eight topless rib linkages 12. The centerpost 10 includes an upper section 14 and a lower section 15 telescopable relative one to the other between collapsed (FIG. 3) and erected (FIG. 1) positions, same being held in the erected position by a first spring loaded latch 16 in accord with known umbrella practice. The umbrella cover 11 is supported, by eight separate rib linkages 12, all these linkages being identical one to the other. The rib topless linkages 12 interconnect with the umbrella's ferrule 17, and with the umbrella's runner 18. The umbrella's ferrule 17 is fixed to the top end of the centerpost, and the runner is movable or slidable along the centerpost for raising and lowering the cover 11. The runner 18 is held in an upper or umbrella full opened position by a second spring loaded latch 19 also in accord with known umbrella practice. A handle 20 is fixed to the bottom end of the centerpost 10 so the umbrella can be easily held by the user when it is open.

It is the umbrella rib linkage 12 system to which this invention is directed, and the invention is described here in connection with one such topless rib linkage although as earlier mentioned all eight rib linkages are identical one with the other. Each topless rib linkage 12 includes a cover rib 25 to which the cover 11 is fixed at its outer periphery 26 as at 27, e.g., by tying with thread. The cover rib 25 extends radially inward toward the umbrella's centerpost 10, but is of length L only equal to about one-half the radius L' of the umbrella's cover so that the cover rib terminates as at its inner end 28 about midway between the cover's periphery 26 and the centerpost. It is this cover rib 25 structure, which cover rib 25 is not connected to the umbrella's ferrule 17, that gives use to the "topless" reference in the characterization of a topless rib linkage system.

The topless rib linkage 12 also includes a stretcher rib 30 pivotally connected as at 31 at its inner end 32 to the runner 18, and pivotally connected as at 33 at its outer end 34 to the cover rib 25. Note the stretcher rib 30 is generally linear from one end 32 to the other 34, and defines longitudinal axis 35 when the rib linkage 12 is relaxed as shown in FIG. 3. A bracket 37 is mounted to the inner end 28 of the cover rib 25, the bracket being configured to establish a generally radially inward and downward directed dog leg at the inner end 28 of that cover rib. It is at toe end 38 of the cover rib dog leg's foot 39 that the stretcher rib 30 is pivotally connected. As is apparent from FIG. 1, therefor, the pivot connection 33 of the cover rib 25 with the stretcher rib 30 is spaced inward of the longitudinal axis 40 of that cover rib. Thus, and as particularly shown in FIG. 1, the pivot connection 33 of the stretcher rib 30 with the cover rib 25 is spaced slightly inward of the cover 11 itself when the umbrella is full opened to minimize rubbing, and thereby wear, of the cover at that point.

The rib linkage 12 further includes a support rib 42 pivotally connected as at 43 at inner end 44 to the ferrule 17, and pivotally connected as at 45 intermediate its inner and outer 46 ends to the stretcher rib 30. The intermediate pivot connection 45 is established by ears 47 mounted to the stretcher rib 30 that locate that pivot connection 45 above and outboard of the stretcher rib 30, i.e., between the stretcher rib and the umbrella's cover 11 and above the longitudinal axis 35 of that stretcher rib. The outer end 46 of the support rib 42 is formed to establish a generally radially outward and upward directed dog leg configuration, the support rib's dog leg configuration being substantially a reverse image of the dog leg configuration provided on the inner end 28 of the cover rib 25. In other words, angle 49 at dog leg end 28 of the cover rib 25 is substantially the same as angle 50 at dog leg end 46 of the support rib 42. As shown in FIG. 1, the stretcher rib 32, support rib 42 and centerpost 14 define a profile opening above the stretcher rib of generally triangle configuration when the umbrella is held upright in the full open position.

The rib linkage 12 also includes a control link 52 pivotally connected as at 53 at its inner end 54 to the support rib 42, and pivotally connected as at 55 at its outer end 56 to the cover rib 25. Note particularly that the former point connection 53 is therefor established between the support rib's longitudinal axis 57 and the cover rib's longitudinal axis 40, i.e., is not on the support rib's longitudinal axis. This, of course, is because of the radially outward directed dog leg configuration of the outer end 46 of the support rib 42. Inwardly directed ears 58, that are part of bracket 37, are mounted to the cover rib 25 adjacent its inner end 28 to establish the pivot connection 55 of the control link 52 with the cover rib 25. The pivot connection 55 so defined is inwardly positioned relative to the longitudinal axis 40 of the cover rib 25. Note particularly the linear axis 60 of the foot end 46 of the support rib 42 is generally coaxial with the linear axis 62 of the control link 52 when the umbrella is full opened as shown in FIG. 1, but not otherwise.

Figure 2:
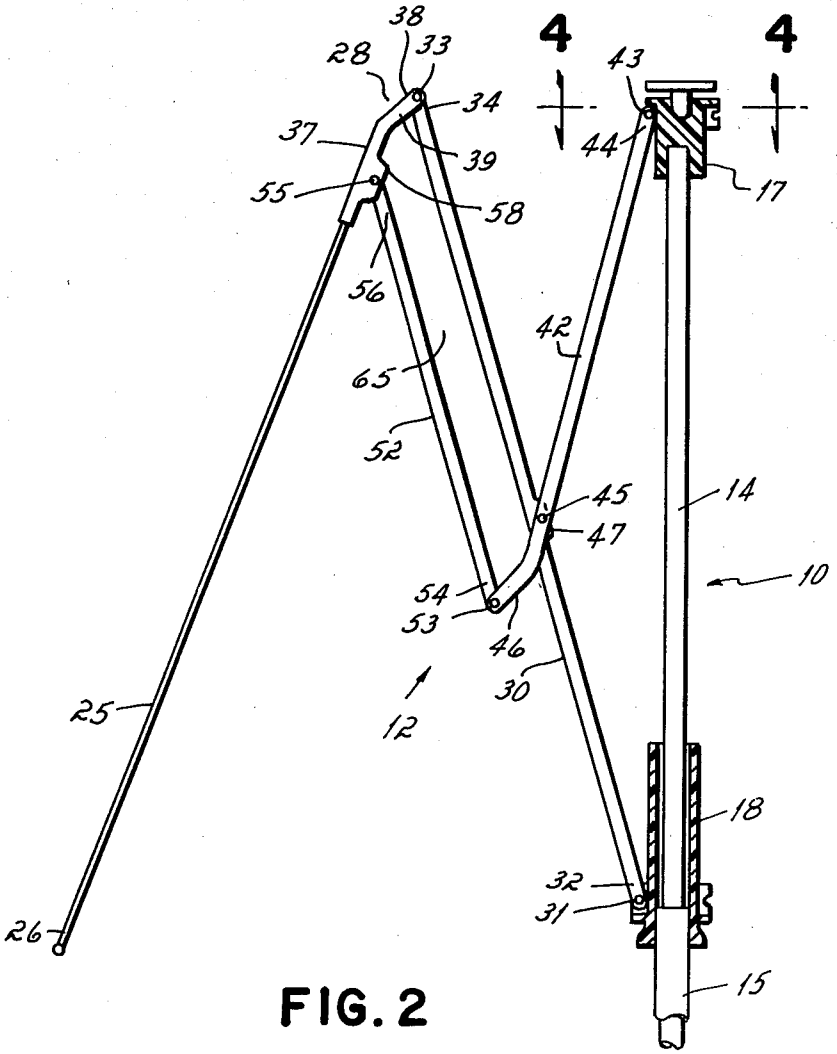
FIG. 2 is a side view similar to FIG. 1 but showing the umbrella in an intermediate open position.

The configuration of the rib linkage 12, i.e., the stretcher rib 30, the support 42, the control link 52 and the cover rib 25, when the umbrella is in an intermediate open/close position is as shown in FIG. 2, and when the umbrella is in a full opened position is as shown in FIG. 1. In both of these positions, the control link 52 is oriented beneath the stretcher rib 30, i.e., the control link is underslung beneath the stretcher rib, so as to define a rib linkage profile opening 65 slung under or positioned beneath the stretcher rib when the umbrella is held vertically upright in a use position. When the umbrella rib linkage 12 is in the intermediate open/close position, this underslung opening 65 is of a generally parallelogram configuration as shown in FIG. 2. On the other hand, when the umbrella rib linkage 12 is in the full opened position this underslung opening 65 is of a generally triangular configuration as shown in FIG. 1. This parallelogram/triangle configuration change of the profile opening 65, it is believed, enhances the structural stability of the rib linkage 12 during use of the umbrella. And the fact that the control link 52 is underslung beneath the stretcher rib 30 in this rib linkage 12 permits the umbrella to be collapsed to a shorter length X, as shown in FIG. 3, for easier storage in smaller spaces than would be the case if the control link was above the stretcher rib 30 (as is currently used in topless umbrella rib linkages currently sold in the market place, and as shown in U.S. Pat. No. 3,467,115). This parallelogram/-triangle interrelationship of the rib linkage profile opening 65 defined by the stretcher rib 30, support rib 42, control link 52, and cover rib 25, between the intermediate (FIG. 3) and full opened (FIG. 1) positions of the umbrella, is made possible by virtue of the dog leg configuration of the support rib 42 at its outer end 46, and the fact that the pivot connection 53 of the control link 52 with the support rib 42 is radially outward of the longitudinal axis 57 of that support rib. In this regard, and as shown in FIG. 1, when the umbrella is full opened and held upright note that the corner point of the triangular configuration formed by stretcher rib 30 and support rib 42, and the adjacent corner point of the triangle configuration formed by stretcher rib 30 and control link 52, are spaced one from the other along the stretcher rib, i.e, are not common one with the other, because pivot points 45, 53 are spaced one from the other.

Figure 4:
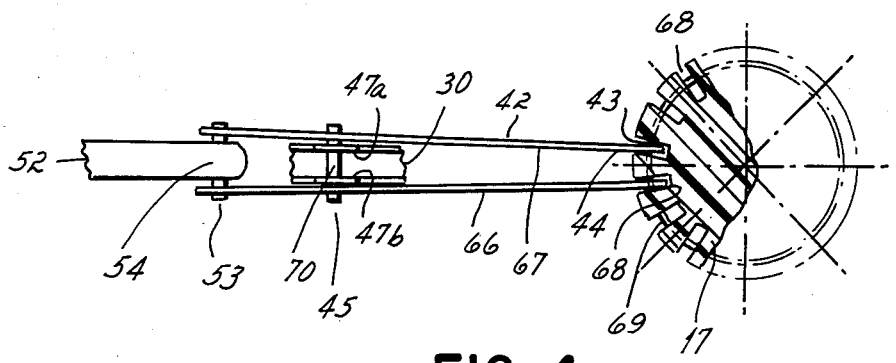
FIG. 4 is a cross sectional view taken along line 4—4 of FIG. 2.
Figure 5:
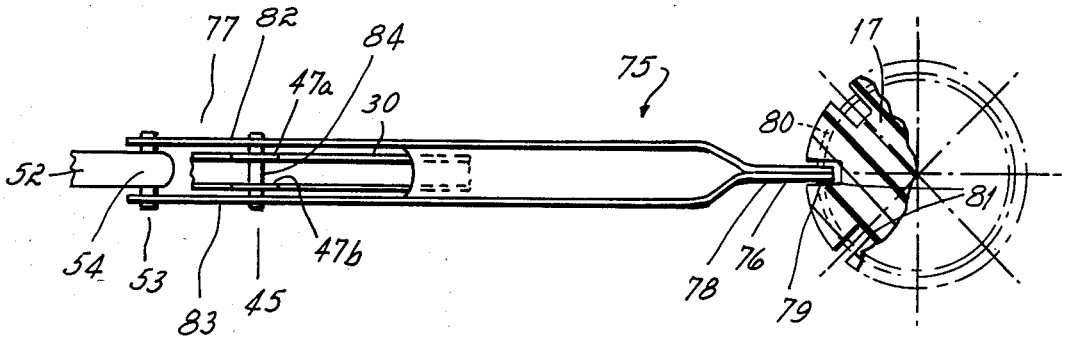
FIG. 5 is a cross sectional view similar to FIG. 4 but illustrating an alternative embodiment.

The structural rigidity of the rib linkage 12, when the umbrella is full opened, is also enhanced by the structure of the support rib 42 at its outer end 46 and in that area where same is pivotally connected to the stretcher rib 30, see FIGS. 4 and 5. The stretcher rib 30, in cross section, is of a generally U-shaped configuration at the point 45 where it is pivotally connected with the support rib 42. The stretcher rib 30 provides two ears 47 that stand upwardly above the stretcher rib's longitudinal axis 35. The support rib 42, in preferred form as shown in FIG. 4, is defined by a pair of struts 66, 67 pivotally connected to the ferrule 17 in equally spaced radial slots 68 by wire 69, the struts being parallel one with the other. One 66 of each pair of struts is pivotally connected to one **47*a* of the stretcher rib's ears, and the other 67 of the struts is pivotally connected to the other 47***b* of the stretcher rib's ear, same being connected by common pin 70. Note the struts 66, 67 of support rib 42 are located outboard of the stretcher rib 30 on opposite sides thereof to entrap the stretcher rib therebetween. And further, note the toe end 46*a* on one 66 of the support struts is connected on one side of the control link 52, and the toe 46*b* of the other 67 of the support struts is connected on the other side of the control link. This bifurcated dog leg 57, 60 structure of the support rib 42 at its outer end where it is connected to the stretcher rib 30 and to the control link 52 is also important relative to enhancing the structural stability of the rib linkage 12. Thus, the topless rib linkage 12 stability is enhanced against wind type forces that are exerted against the umbrella cover 11 during use of the umbrella, those forces being shown diagrammaticaly by phantom arrows 71A, 71B disposed generally parallel to the centerpost 14 as well by phantom arrows 72, 73 generally perpendicular to the centerpost. The point here is that the support rib 42 structure at its interconnection 45 with the stretcher rib 30 as well as with the control link 52, in combination with the geometry of the support rib at its dog leg outer end 46 which provides the parallelogram/triangle configuration of the opening 65 defined by the rib linkage 12 in the intermediate (FIG. 2) and full opened (FIG. 1) position of the umbrella, all cooperate to enhance the stability of that topless umbrella rib linkage.

An alternative embodiment of the support rib 42 is illustrated in FIG. 5. The alternative embodiment of the support rib differs from the FIG. 4 embodiment in that the alternative embodiment support rib 75 is of a single piece or unitary configuration. The alternative support rib 75 is of a generally U-shaped cross sectional configuration throughout its length except at its inner end 76 and at its outer end 77. At its inner end 76, the U-shaped support 75 is pressed together as at 78 to provide a single pivot connection 79 at which the support rib is pivotally connected by wire 80 in a single slot 81 to the ferrule 17. At its outer end 77, however, the U-shaped support rib 75 is bifurcated as is the case with the support rib 42 shown in FIG. 4. This bifurcated end 77 defines opposite parallel struts 82, 83, each of the struts being of a dog leg configuration identical to the dog leg end 46 of support rib 42. As is the case with the FIG. 4 embodiment, the dog leg sections 82, 83 so defined at the outer end 77 of the alternative support rib 75 are pivotally connected by pin 84 on the outboard sides of the stretcher rib 30, and on the outboard side of the end 54 of the control link 52. This alternative embodiment support rib 75 also improves the structural stability of the rib linkage 12 when the umbrella is in the full opened position.

Having described in detail the preferred embodiment of our invention, what we desire to claim and protect by Letter of Patent is:

1. An umbrella comprising a centerpost having a runner slidable thereon, a cover connected at its center to said centerpost, and a topless rib linkage beneath said cover, said linkage having a cover rib to which said cover is connected, said cover rib having a bend therein at an inner end closest to said centerpost, a straight stretcher rib connecting said runner and said cover rib, said stretcher rib being attached to said cover rib at the inner end thereof on one side of said bend, a support rib connecting said stretcher rib and said centerpost, and a control link located beneath said stretcher rib and connecting said support rib and said cover rib, said control link being attached to said cover rib on the other side of said bend and spaced away from said cover rib inner end, said bend of said cover rib being oriented to angle said inner end of said cover rib away from said cover so that the connection of said cover rib and said stretcher rib is displaced away from said cover when said rib linkage is in a full opened position, and said stretcher rib, cover rib, support rib and control link defining a profile opening of generally parallelogram configuration beneath said stretcher rib of when said umbrella is held upright and said rib linkage is between full opened and full closed positions, and defining a profile opening of a generally triangle configuration beneath said stretcher rib when said umbrella is held upright and said rib linkage is in said full opened position, wherein said support rib further comprises a bend between the connections of said stretcher rib and said control link providing a generally coaxial alignment of an outermost segment of the support rib and the control link when said linkage is in said full opened position.

2. An umbrella as set forth in claim 1, said support rib being connected to said stretcher rib at a location between the ends of said support rib and said control link being connected to an outer end of said support rib thereby locating said control link beneath said stretcher rib when said umbrella is full opened and held in an upright use position.

3. An umbrella as set forth in claim 2, the outer end of said support rib having a generally dog leg configuration, said dog leg configuration comprising a first end generally coaxial with the inner end of the support rib and a toe end angled upwardly from said first end to define a support rib angle.

4. An umbrella as set forth in claim 3, the longitudinal axis of the toe end of said dog leg of said support rib being generally coaxial with the longitudinal axis of said control link when said umbrella is in said full opened position.

5. An umbrella as set forth in claim 4, the connection of said support rib with said stretcher rib being located above said stretcher rib.

6. An umbrella as set forth in claim 3, said bend in said cover rib defining a cover rib angle of substantially the same size as said support rib angle.

7. An umbrella as set forth in claim 6, said outer end of said support rib and said bent end of said cover rib being substantially mirror images one with the other.

8. An umbrella as set forth in claim 2, said support rib being bifurcated at its outer end to provide parallel struts at said outer end, said support rib struts being positioned outboard of said control link and outboard of said stretcher rib at the respective connections of said support rib with said control link, and of said support rib with said stretcher rib, to enhance structural rigidity of the rib linkage.

9. An umbrella as set forth in claim 8, said support rib comprising opposed parallel struts that extend from said centerpost to the connection of said struts with said control link, the outer ends of each of said struts having a dog leg configuration identical one with the other, each said dog leg configuration comprising a first end generally coaxial with the inner end of said strut and a toe end angled upwardly from said first end, and the longitudinal axis of the toe end of each said dog leg being generally coaxial with the longitudinal axis of said control link when said umbrella is full opened.

10. An umbrella as set forth in claim 1, said stretcher rib, support rib and centerpost defining a profile opening above said stretcher rib of generally triangle configuration when said umbrella is held upright in said full opened position.

11. An umbrella as set forth in claim 10, the adjacent points of the two triangle configurations as defined by said stretcher rib and said control link, and by said stretcher rib and said support rib, respectively, being spaced one from the other along said stretcher rib.

12. An umbrella as set forth in claim 2, each of said connections being a pivot connection, and the pivot connection of said stretcher rib and said support rib being spaced from the pivot connection of said stretcher rib and said control link relative to the longitudinal axis of said stretcher rib, and the aforesaid same connection points being positioned on opposite sides of the longitudinal axis of said stretcher rib.

13. An umbrella comprising a centerpost having a runner slidable thereon, a cover connected at its center to said centerpost, and a topless rib linkage beneath said cover, said linkage having a cover rib to which said cover is connected, said cover rib having a bend therein at an inner end closest to said centerpost, a straight stretcher rib connecting said runner and said cover rib, said stretcher rib being attached to said cover rib at the inner end thereof on one side of said band, a support rib connecting said centerpost and said stretcher rib, said support rib being pivotally connected to said stretcher rib, and a control link connecting said support rib and said cover rib, said control link being attached to said cover rib on the other side of said bend and spaced away from said inner end, said bend of said cover rib being oriented to angle said inner end of said cover rib away from the cover so that the connection of said cover rib and said stretcher rib is displaced away from said cover when said umbrella is in a full opened position, said cover rib being indirectly connected to said centerpost only through said connections with said stretcher rib, support rib and control link so as not to be directly connected thereto, and said support rib being bifurcated at least at its outer end to provide parallel struts at said outer end, said support rib struts being positioned outboard of said control link and outboard of said stretcher rib at the respective connections of said support rib with said control link, and of said support rib with said stretcher rib, to enhance structural rigidity of the rib linkage, said support rib struts further comprise a bend providing a generally coaxial alignment of an outermost segment of each strut with said control link when said linkage is in said full opened position.

14. An umbrella as set forth in claim 13, said support rib being connected to said stretcher rib at a location between the ends of said support rib and said control link being connected to the outer end of said support rib thereby locating said control link beneath said stretcher rib when said umbrella is in said full opened position and is held in an upright use position.

15. An umbrella as set forth in claim 14, the outer end of said support rib having a generally dog leg configuration, said dog leg configuration comprising a first end generally coaxial with the inner end of the support rib and a toe end angled upwardly from said first end to define a support rib angle.

16. An umbrella as set forth in claim 14, said stretcher rib, cover rib, support rib and control link defining a profile opening of generally parallelogram configuration when said umbrella is between said full opened position and a full closed position, and defining a profile opening of a generally triangle configuration when said umbrella is in said full opened position.

17. An umbrella as set forth in claim 15, the longitudinal axis of the toe end of said dog leg of said support rib being generally coaxial with the longitudinal axis of said control link when said umbrella is in said full opened position.

18. An umbrella as set forth in claim 17, the connection of said support rib with said stretcher rib being located above said stretcher rib.

19. An umbrella as set forth in claim 15, said bend in said cover rib defining a cover rib angle of substantially the same size as said support rib angle.

20. An umbrella as set forth in claim 19, said outer end of said dog leg of said support rib and said bent end of said cover rib being substantially mirror images one with the other.

21. An umbrella as set forth in claim 13, said support rib comprising opposed parallel struts that extend from said centerpost to the connection of said struts with said control link, the outer ends of each of said struts having a dog leg configuration identical one with the other, each said dog leg configuration comprising a first end generally coaxial with the inner end of said strut and a toe end angled upwardly from said first end, and the longitudinal axis of the toe end of each said dog leg being generally coaxial with the longitudinal axis of said control link when said umbrella is full opened.

22. An umbrella comprising, a centerpost having a runner slidable thereon, a cover connected at its center to said centerpost, and a topless rib linkage having a cover rib to which said cover is connected, a straight stretcher rib connecting said runner and an inner end of said cover rib, the inner end of said cover rib being of generally first dog leg configuration, said first dog leg configuration comprising a first end generally coaxial with an outer end of said cover rib and a toe angled downwardly and inwardly from said first end of said first dog leg to define a first angle, said stretcher rib being connected to said toe end of said cover rib, a support rib pivotally connected to said stretcher rib at a location intermediate the ends of said support rib and also connected to said centerpost, an outer end of said support rib being of a generally second dog leg configuration, said second dog leg configuration comprising a first end generally coaxial with the inner end of said support rib and a toe end angled upwardly and outwardly from said first end of said second dog leg to define a second angle, and a control link connecting said toe end of said support rib with said cover rib at a location intermediate the ends of said cover rib said control link being connected to the toe end of said support rib for locating said control link beneath said stretcher rib when said umbrella is full opened and held in an upright use position, the longitudinal axis of the toe end of said support rib being generally coaxial with the longitudinal axis of said control link and the longitudinal axis of the toe end of said cover rib being generally coaxial with the longitudinal axis of said stretcher rib when said umbrella is fully opened.

23. An umbrella as set forth in claim 22, said stretcher rib, cover rib, support rib and control link defining a profile opening of generally parallelogram configuration when said umbrella is between full opened and full closed positions, and defining a profile opening of generally triangle configuration when said umbrella is in said full opened position.

24. An umbrella as set forth in claim 22, said first angle defined by said first dog leg configuration and said second angle defined by said second dog leg configuration being of substantially the same size.

25. An umbrella as set forth in claim 24, said toe end of said support rib and said toe end of said cover rib being substantially mirror images one with the other.

26. An umbrella as set forth in claim 22, the connection of said support rib with said stretcher rib being located above said stretcher rib.

27. An umbrella as set forth in claim 22, said support rib being bifurcated at its outer end to provide parallel struts at said outer end, said support rib struts being positioned outboard of said control link and outboard of said stretcher rib at the respective connections of said support rib with said control link, and of said support rib with said stretcher rib, to enhance structural rigidity of the rib linkage.

28. An umbrella as set forth in claim 27, said support rib comprising opposed parallel struts that extend from said centerpost to the connection of said struts with said control link, the outer ends of each of said struts having said second dog leg configuration identical one with the other, and the longitudinal axis of the toe end of each said strut being generally coaxial with the longitudinal axis of said control link when said umbrella is fully opened.

* * * * *